US011378914B2

(12) United States Patent
Ogawa et al.

(10) Patent No.: US 11,378,914 B2
(45) Date of Patent: Jul. 5, 2022

(54) PROCESS CARTRIDGE AND IMAGE FORMING APPARATUS

(71) Applicant: CANON KABUSHIKI KAISHA, Tokyo (JP)

(72) Inventors: Tsuyoshi Ogawa, Tokyo (JP); Tomonori Mori, Numazu (JP); Daisuke Abe, Suntou-gun (JP); Noriyuki Komatsu, Numazu (JP); Hideshi Kawaguchi, Numazu (JP); Tadayuki Tsuda, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/186,183

(22) Filed: Feb. 26, 2021

(65) Prior Publication Data

US 2021/0181672 A1 Jun. 17, 2021

Related U.S. Application Data

(62) Division of application No. 16/693,617, filed on Nov. 25, 2019, now Pat. No. 10,948,872.

(30) Foreign Application Priority Data

Nov. 30, 2018 (JP) ..... JP2018-224735

(51) Int. Cl.

| | |
|---|---|
| ***G03G 21/18*** | (2006.01) |
| ***G03G 15/00*** | (2006.01) |
| ***G03G 21/16*** | (2006.01) |
| ***G03G 15/08*** | (2006.01) |

(52) U.S. Cl.

CPC ..... *G03G 21/1885* (2013.01); *G03G 15/0863* (2013.01); *G03G 15/553* (2013.01); *G03G 15/556* (2013.01); *G03G 15/80* (2013.01); *G03G 21/1652* (2013.01); *G03G 21/1867* (2013.01); *G03G 21/1875* (2013.01); *G03G 21/1878* (2013.01); *G03G 2215/0695* (2013.01); *G03G 2215/0697* (2013.01)

(58) Field of Classification Search

CPC ..... G03G 15/0863; G03G 15/553; G03G 15/556; G03G 15/80; G03G 21/1652; G03G 21/1867; G03G 21/1875; G03G 21/1878; G03G 21/1885; G03G 2215/0695; G03G 2215/0697

See application file for complete search history.

(56) References Cited

U.S. PATENT DOCUMENTS

| | | | |
|---|---|---|---|
| 5,126,800 | A | 6/1992 | Shishido et al. |
| 5,151,734 | A | 9/1992 | Tsuda et al. |
| 5,208,634 | A | 5/1993 | Ikemoto et al. |

(Continued)

FOREIGN PATENT DOCUMENTS

JP 2004-037876 A 2/2004

*Primary Examiner* — Joseph S Wong
(74) *Attorney, Agent, or Firm* — Venable LLP

(57) ABSTRACT

A process cartridge mountable in and dismountable from an image forming apparatus includes a frame, a storing portion provided on a mounting surface of the frame and configured to store information on the process cartridge, a projection projecting outwardly of the mounting surface in a direction normal to the mounting surface, and an electrical contact portion mounted on the projection and electrically connected to the storing portion.

10 Claims, 11 Drawing Sheets

(a)

(b)

(56) References Cited

U.S. PATENT DOCUMENTS 5,223,893 A 6/1993 Ikemoto et al.
5,294,960 A 3/1994 Nomura et al.
5,331,372 A 7/1994 Tsuda et al.
5,345,294 A 9/1994 Nomura et al.
5,404,198 A 4/1995 Noda et al.
5,470,635 A 11/1995 Shirai et al.
5,475,470 A 12/1995 Sasago et al.
5,488,459 A 1/1996 Tsuda et al.
5,510,878 A 4/1996 Noda et al.
5,561,504 A 10/1996 Watanabe et al.
5,581,325 A 12/1996 Tsuda et al.
5,583,613 A 12/1996 Kobayashi et al.
5,602,623 A 2/1997 Nishibata et al.
5,608,509 A 3/1997 Shirai et al.
5,623,328 A 4/1997 Tsuda et al.
5,659,847 A 8/1997 Tsuda et al.
5,669,042 A 9/1997 Kobayashi et al.
5,682,579 A 10/1997 Nomura et al.
5,809,374 A 9/1998 Tsuda et al.
5,812,909 A 9/1998 Oguma et al.
5,828,928 A 10/1998 Sasago et al.
5,828,929 A 10/1998 Watanabe et al.
5,878,304 A 3/1999 Watanabe et al.
5,907,749 A 5/1999 Nomura et al.
5,923,918 A 7/1999 Nakagawa et al.
5,926,672 A 7/1999 Nishibata et al.
5,987,278 A 11/1999 Nomura et al.
6,006,058 A 12/1999 Watanabe et al.
6,011,941 A 1/2000 Takashima et al.
6,041,196 A 3/2000 Nakagawa et al.
6,058,278 A 5/2000 Tsuda et al.
6,075,956 A 6/2000 Watanabe et al.
6,097,906 A 8/2000 Matsuzaki et al.
6,097,911 A 8/2000 Watanabe et al.
6,118,961 A 9/2000 Nomura et al.
6,131,011 A 10/2000 Kojima et al.
6,154,623 A 11/2000 Suzuki et al.
6,157,792 A 12/2000 Mori et al.
6,173,145 B1 1/2001 Chadani et al.
6,178,301 B1 1/2001 Kojima et al.
6,266,503 B1 7/2001 Murayama et al.
6,298,217 B1 10/2001 Murayama et al.
6,314,266 B1 11/2001 Murayama et al.
6,324,363 B1 11/2001 Watanabe et al.
6,334,035 B1 12/2001 Abe et al.
6,377,759 B1 4/2002 Abe et al.
6,404,996 B1 6/2002 Mori et al.
6,415,121 B1 7/2002 Suzuki et al.
6,424,811 B1 7/2002 Tsuda et al.
6,463,225 B1 10/2002 Abe et al.
6,473,585 B2 10/2002 Abe et al.
6,505,008 B2 1/2003 Abe
6,519,431 B1 2/2003 Toba et al.
6,535,699 B1 3/2003 Abe et al.
6,542,706 B2 4/2003 Toba et al.
6,603,939 B1 8/2003 Toba et al.
6,654,578 B2 11/2003 Suzuki et al.
6,671,477 B2 12/2003 Komatsu et al.
6,823,155 B2 11/2004 Tsuda et al.
6,826,380 B2 11/2004 Karakama et al.
6,915,092 B2 7/2005 Yamaguchi et al.
6,934,485 B2 8/2005 Miyabe et al.
6,980,759 B2 12/2005 Kanno et al.
6,993,264 B2 1/2006 Oguma et al.
7,024,131 B2 4/2006 Komatsu et al.
7,082,276 B2 7/2006 Karakama et al.
7,110,703 B2 9/2006 Uratani et al.
7,156,797 B2 1/2007 Komatsu et al.
7,162,176 B2 1/2007 Oguma et al.
7,203,442 B2 4/2007 Matsubara et al.
7,231,164 B2 6/2007 Harada et al.
7,242,885 B2 7/2007 Abe et al.
7,266,326 B2 9/2007 Karakama et al.
7,283,765 B2 10/2007 Uratani et al.
7,315,706 B2 1/2008 Oguma et al.
7,386,241 B2 6/2008 Mori et al.
7,660,550 B2 2/2010 Mori et al.
7,890,025 B2 2/2011 Chadani et al.
7,899,364 B2 3/2011 Chadani et al.
7,983,589 B2 7/2011 Sato et al.
8,116,661 B2 2/2012 Chadani et al.
8,135,304 B2 3/2012 Abe et al.
8,139,972 B2 3/2012 Abe et al.
8,306,460 B2 11/2012 Chadani et al.
8,335,454 B2 12/2012 Chadani et al.
8,442,416 B2 5/2013 Chadani et al.
8,447,209 B2 5/2013 Chadani et al.
8,472,840 B2 6/2013 Abe et al.
8,571,445 B2 10/2013 Komatsu et al.
8,583,007 B2 11/2013 Chadani et al.
8,588,647 B2 11/2013 Chadani et al.
8,639,160 B2 1/2014 Chadani et al.
8,787,794 B2 7/2014 Miyazaki et al.
8,942,592 B2 1/2015 Uratani et al.
9,134,679 B2 9/2015 Mori
9,134,688 B2 9/2015 Chadani et al.
9,304,483 B2 4/2016 Komatsu et al.
9,395,679 B2 7/2016 Kawakami et al.
9,494,890 B2 11/2016 Komatsu et al.
9,581,958 B2 2/2017 Chadani et al.
9,772,598 B2 9/2017 Komatsu et al.
9,778,613 B2 10/2017 Komatsu et al.
9,823,619 B2 11/2017 Kawakami et al.
9,983,542 B2 5/2018 Chadani et al.
10,197,967 B2 2/2019 Komatsu et al.
10,401,783 B2 9/2019 Chadani et al.
10,539,915 B2 1/2020 Mori et al.
10,551,790 B2 2/2020 Komatsu et al.
2001/0043814 A1 11/2001 Abe
2008/0199204 A1 8/2008 Ishii et al.
2013/0336674 A1 12/2013 Abe et al.
2015/0261177 A1* 9/2015 Moon ..... G03G 21/1842 399/90
2018/0046133 A1 2/2018 Kawakami et al.
2019/0187608 A1 6/2019 Uesugi et al.
2019/0227481 A1 7/2019 Chadani et al.
2019/0339643 A1 11/2019 Chadani et al.
2020/0041953 A1 2/2020 Uesugi et al.
2020/0209804 A1 7/2020 Kawakami et al.
2020/0233372 A1 7/2020 Kawakami et al.

* cited by examiner (a)

(b)

(a)

(b)

(a)

(b)

(a)

(b)

(a)

(b)

(a)

(b)

PROCESS CARTRIDGE AND IMAGE FORMING APPARATUS

FIELD OF THE INVENTION AND RELATED ART

The present invention relates to a process cartridge mountable in and dismountable from an image forming apparatus such as an electrophotographic copying machine or an electrophotographic printer, and relates to the image forming apparatus.

In an image forming apparatus of an electrophotographic type, a constitution in which a photosensitive member and a process member actable on the photosensitive member are integrally assembled into a unit as a process cartridge and in which the process cartridge is made mountable in and dismountable from the image forming apparatus has been known. By such a constitution, a maintenance operation in the case where toner is used up or in the case where the process member is broken can be carried out by a user himself (herself), and therefore a maintenance property can be improved remarkably.

Further, in recent years, a constitution in which a storing portion for storing information on the process cartridge, such as various pieces of service information and process information is mounted on the process cartridge is also realized. In this constitution, electrical connection is made between an electrical contact portion provided on an apparatus main assembly side of the image forming apparatus and an electrical contact portion which is provided on a position side and which is electrically connected to the storing portion. Then, electrical communication is carried out between the apparatus main assembly of the image forming apparatus and the storing portion of the process cartridge, and the information stored in the storing portion is used, so that an image quality and a maintenance property can be further improved.

Further, in a process cartridge disclosed in Japanese Laid-Open Application (JP-A) 2004-37876, the electrical contact portion and the storing portion are flushed with each other, and a projection projecting in a mounting direction of the process cartridge is provided. By such a constitution, during falling or the like of the process cartridge, a contact member contacts an external member in advance of the storing portion, and therefore breakage of the storing portion with collision between the external member and the storing portion is suppressed.

However, in the constitution disclosed in JP-A 2004-37876, the storing portion and the electrical contact portion are disposed on the same plane, and therefore, a degree of freedom of arrangement is low, so that there is a liability that the constitution cannot meet upsizing of the storing portion.

Therefore, a process cartridge which can easily meet the upsizing of the storing portion and which can also suppress the breakage of the storing portion with the collision between the external member and the storing portion has been desired.

SUMMARY OF THE INVENTION

According to an aspect of the present invention, there is provided a process cartridge mountable in and dismountable from an image forming apparatus, comprising: a frame; a storing portion provided on a mounting surface of the frame and configured to store information on the process cartridge; a projection projecting outwardly of the mounting surface in a direction normal to the mounting surface; and an electrical contact portion mounted on the projection and electrically connected to the storing portion.

Further features of the present invention will become apparent from the following description of exemplary embodiments with reference to the attached drawings.

BRIEF DESCRIPTION OF THE DRAWINGS

Parts (a) and (b) of FIG. 1 are schematic perspective views of an image forming apparatus.

Figure 4:
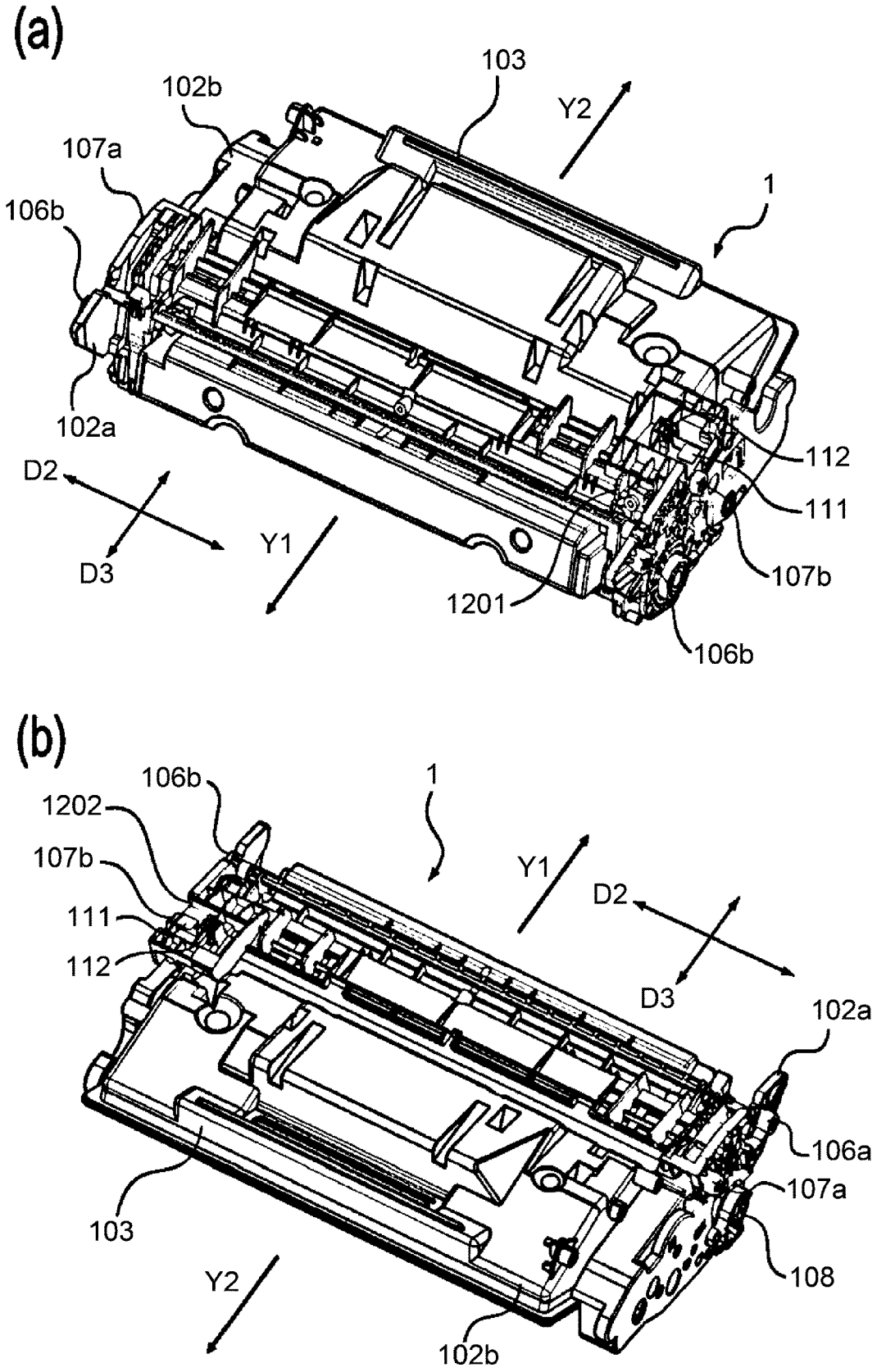

Parts (a) and (b) of FIG. 4 are perspective views of the process cartridge.

Figure 5:
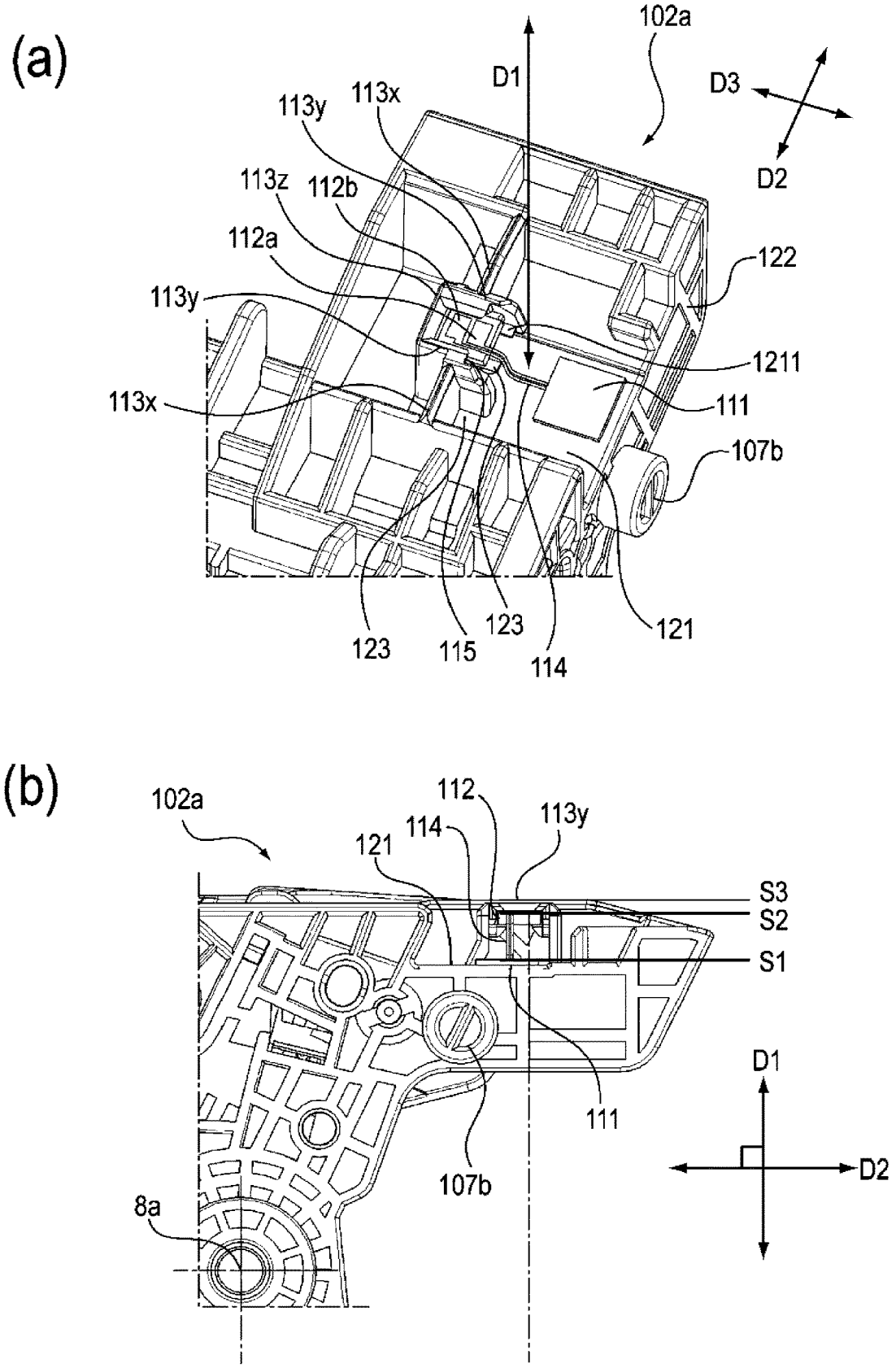

Parts (a) and (b) of FIG. 5 are a perspective view and a side view of a mounted a periphery thereof.

Figure 6:
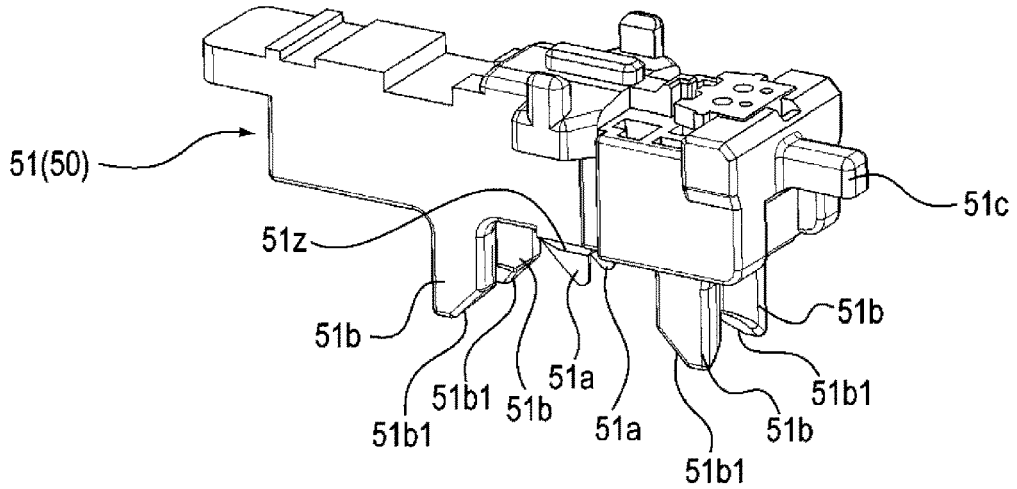
Figure 6:
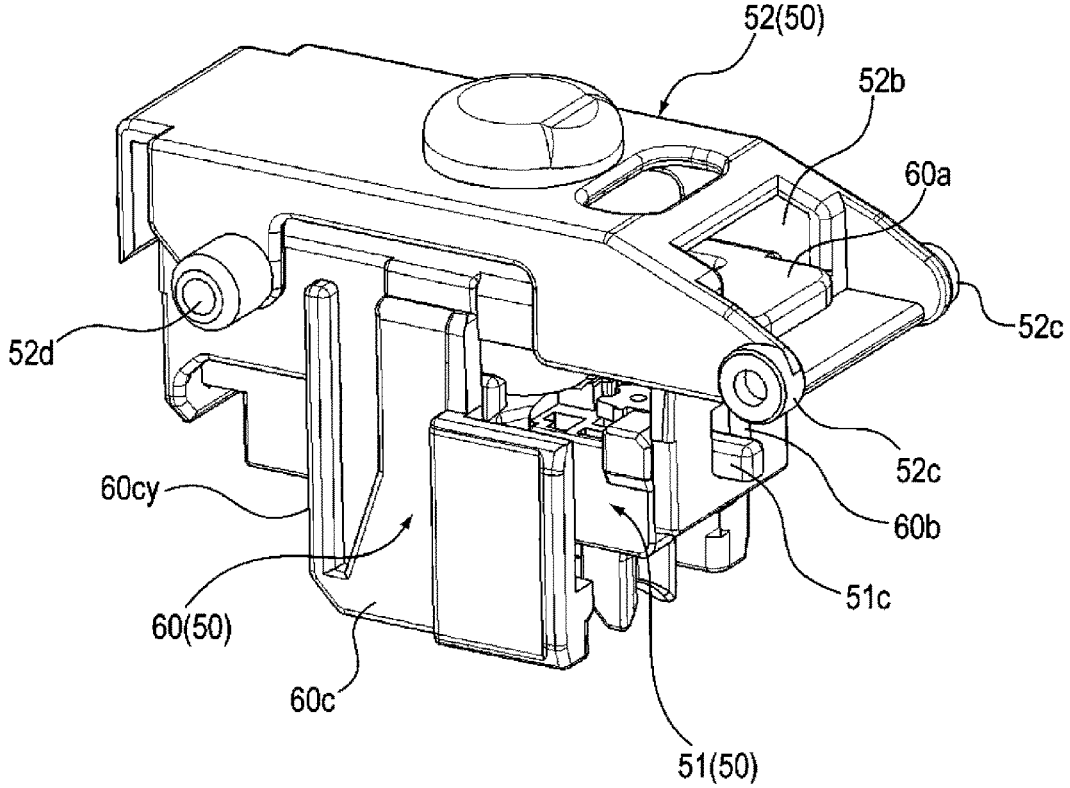

Parts (a) and (b) of FIG. 6 are exploded perspective views of the connector mechanism.

Figure 7:
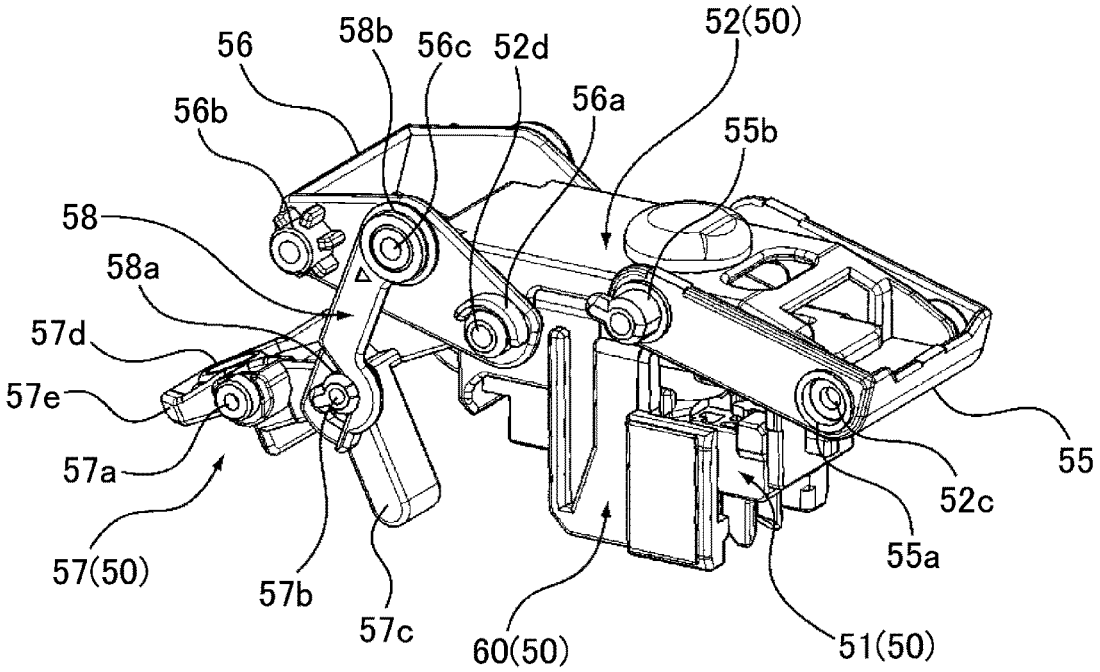
Figure 7:
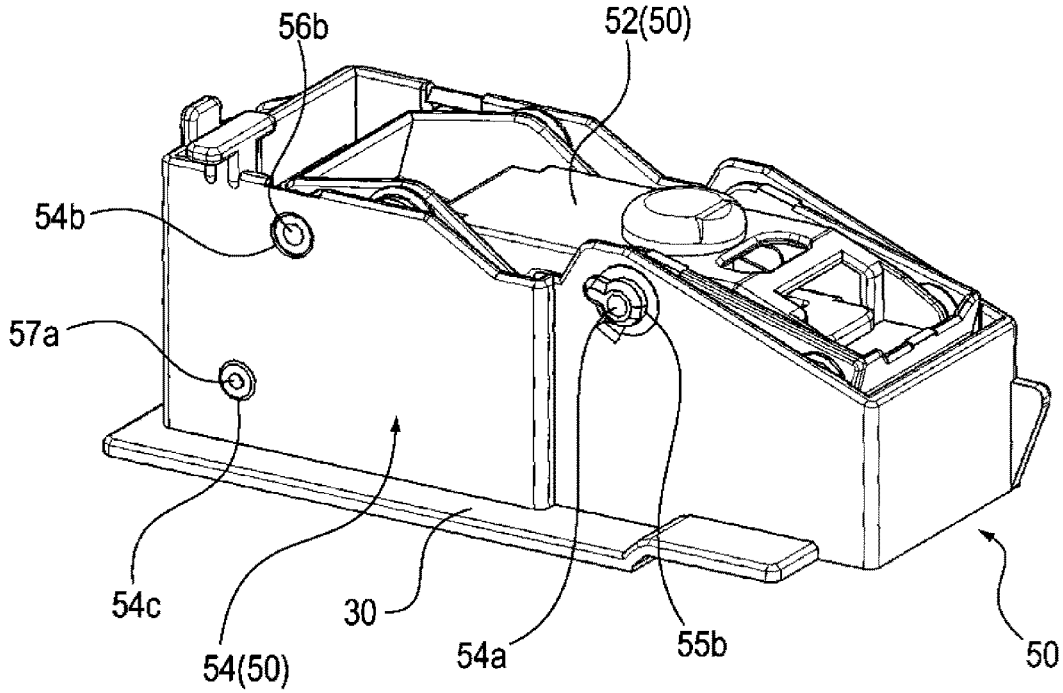

Parts (a) and (b) of FIG. 7 are exploded perspective views of the connector mechanism.

Figure 8:
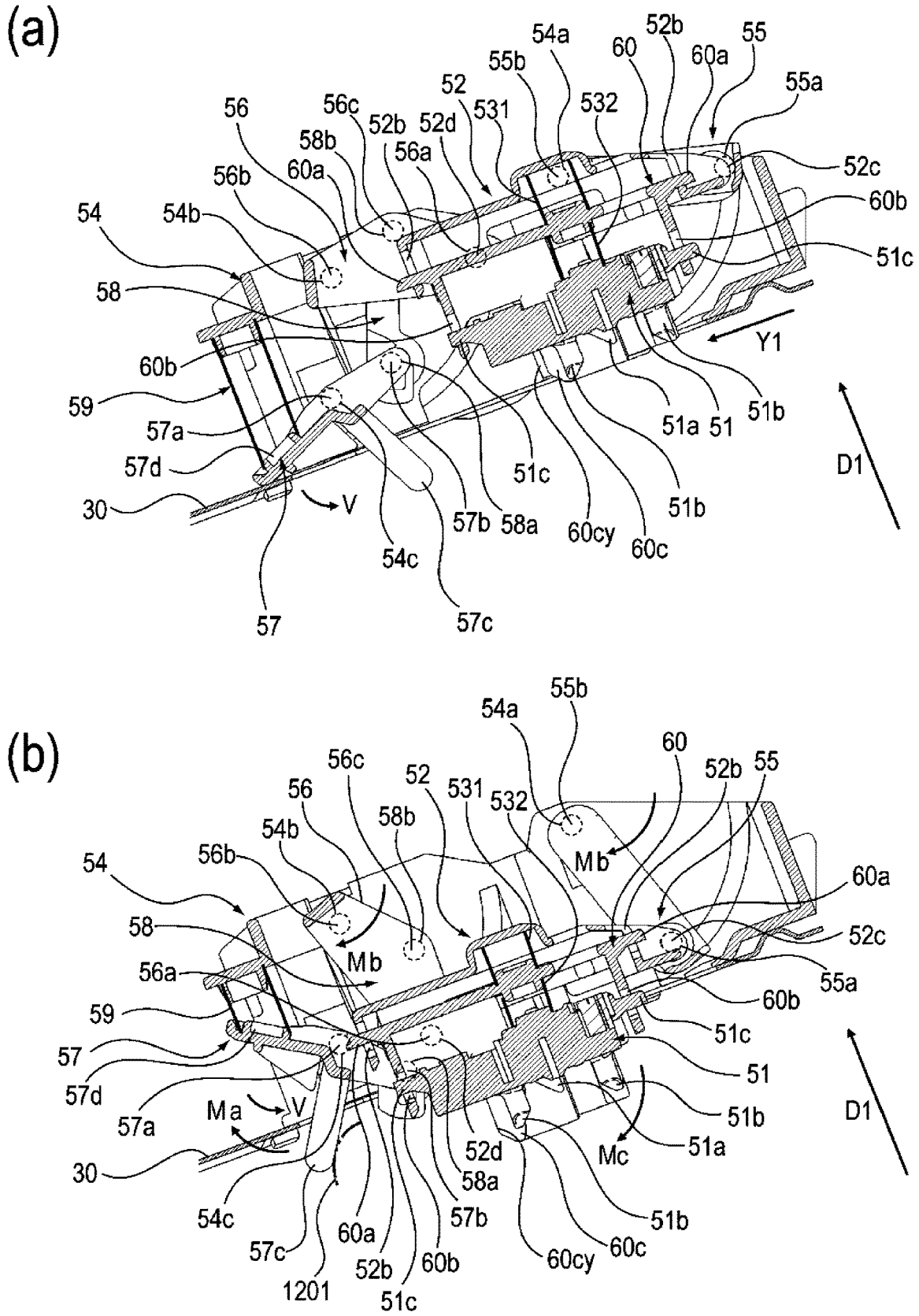

Parts (a) and (b) of FIG. 8 are sectional views of the connector mechanism.

Figure 9:
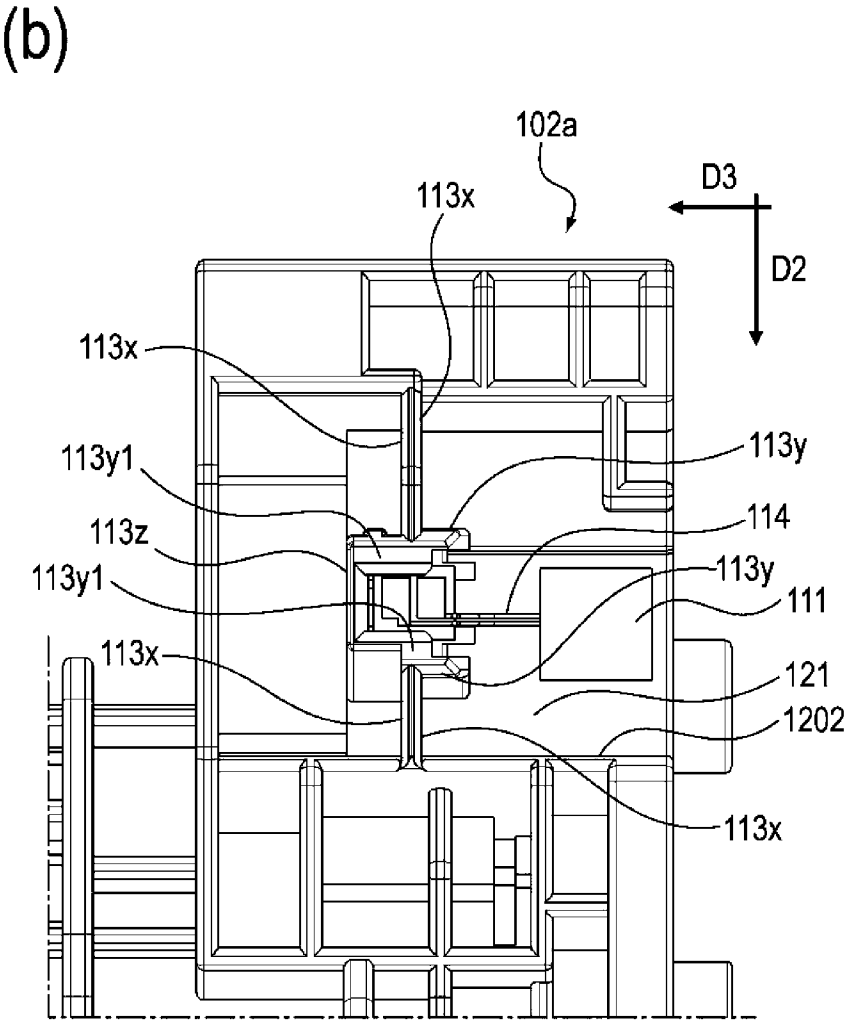
Figure 9:
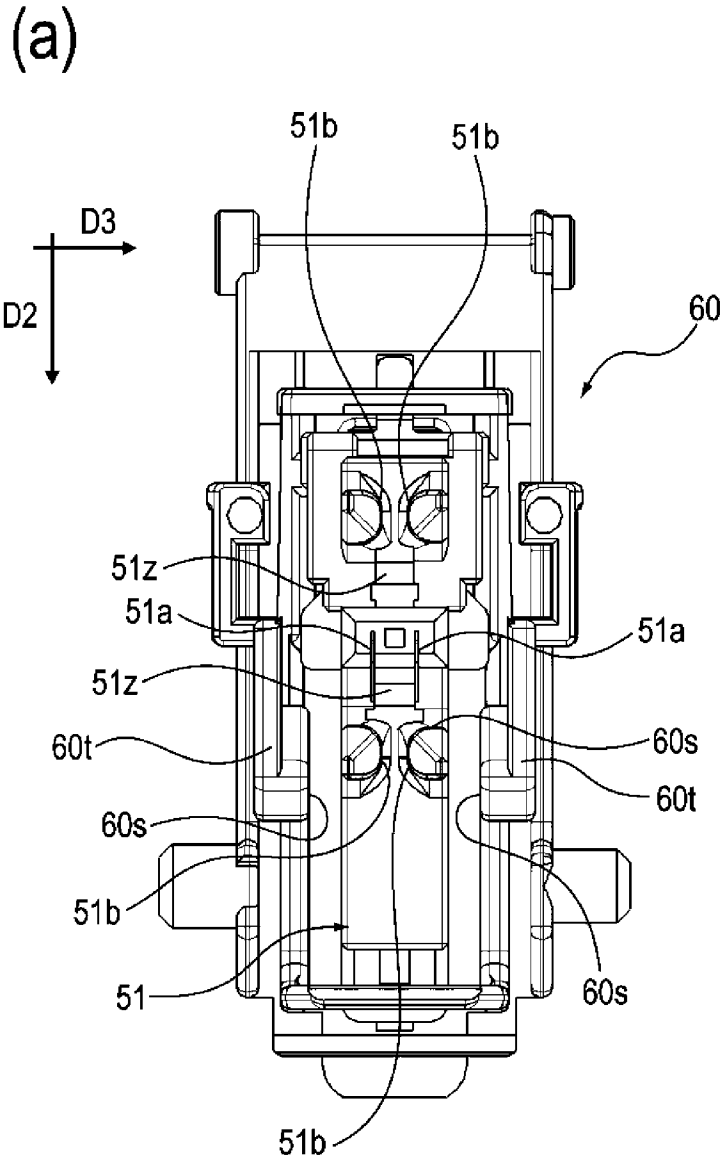

Part (a) of FIG. 9 is a plan view of the connector and a lower connector cover, and part (b) of FIG. 9 is a plan view of the memory unit and the periphery thereof.

Figure 10:
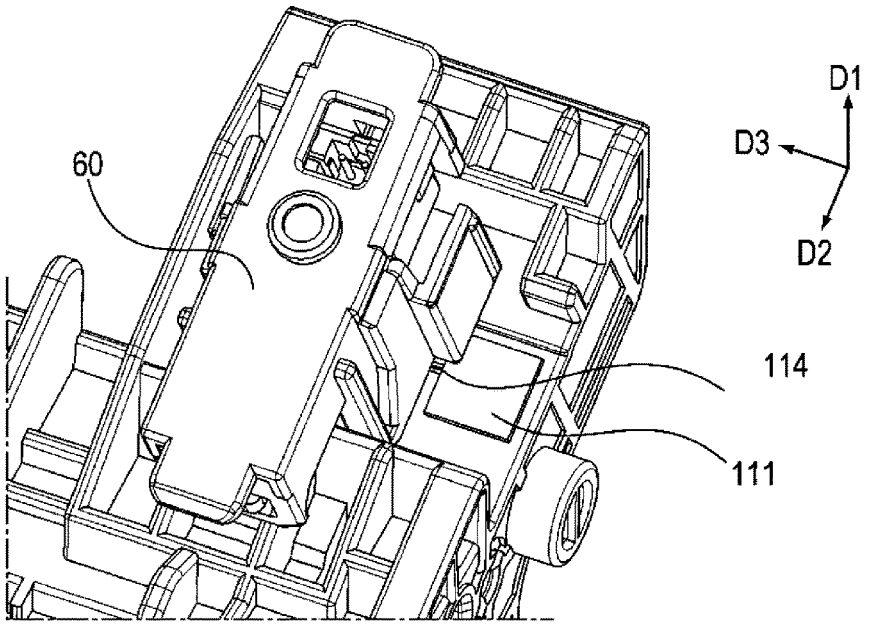
Figure 10:
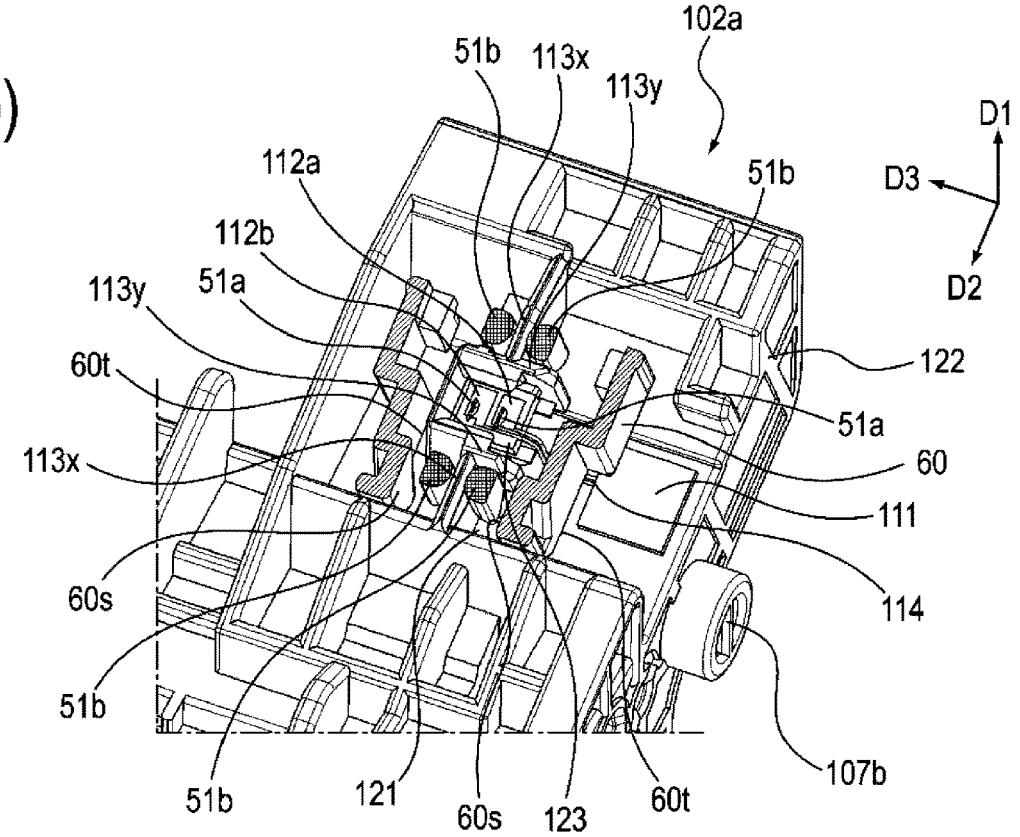

Parts (a) and (b) of FIG. 10 are perspective views of the connector, the lower connector cover and the process cartridge.

Figure 11:
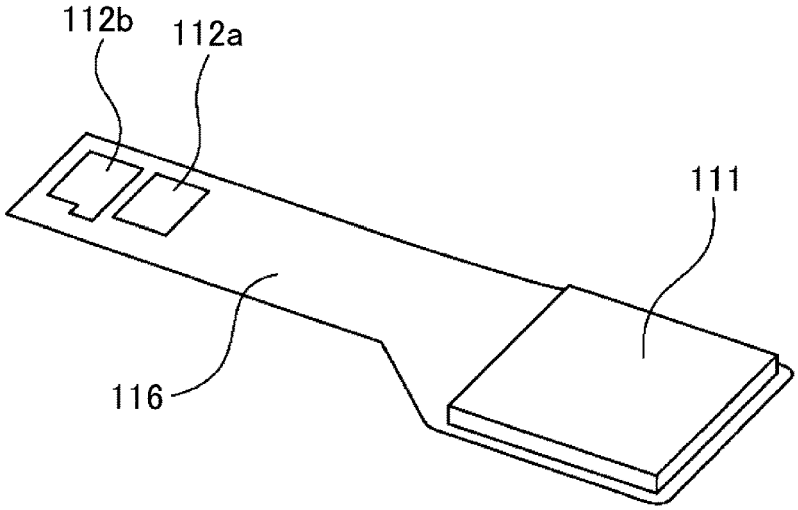
Figure 11:
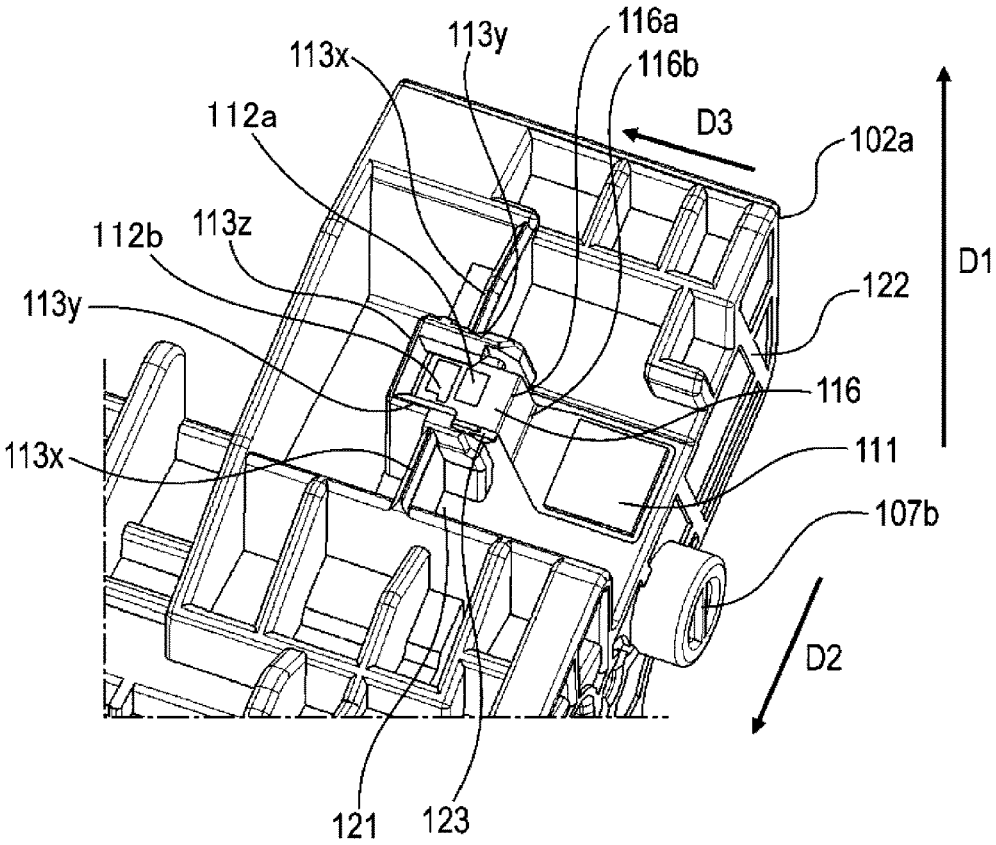

Part (a) of FIG. 11 is a perspective view of the memory unit and the electrical contact portion, and part (b) of FIG. 11 is a perspective view of the process cartridge.

Figure 12:
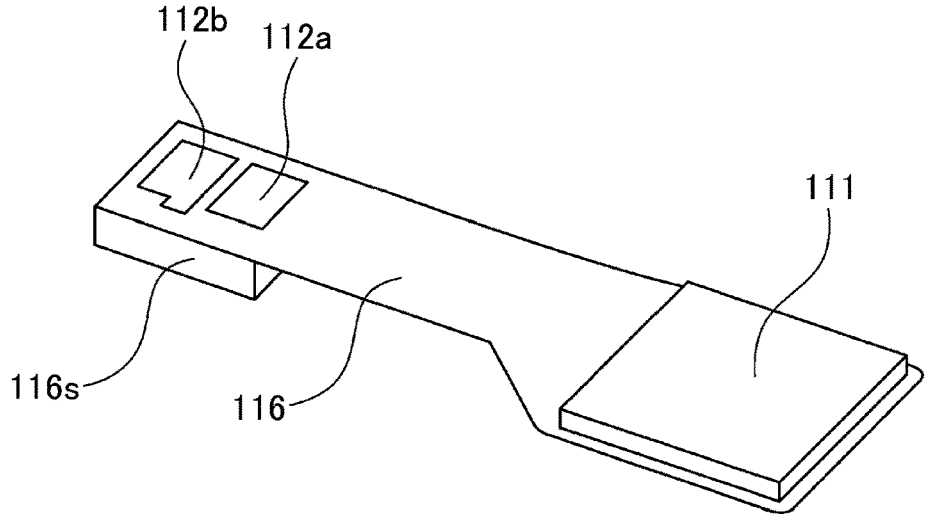
Figure 12:
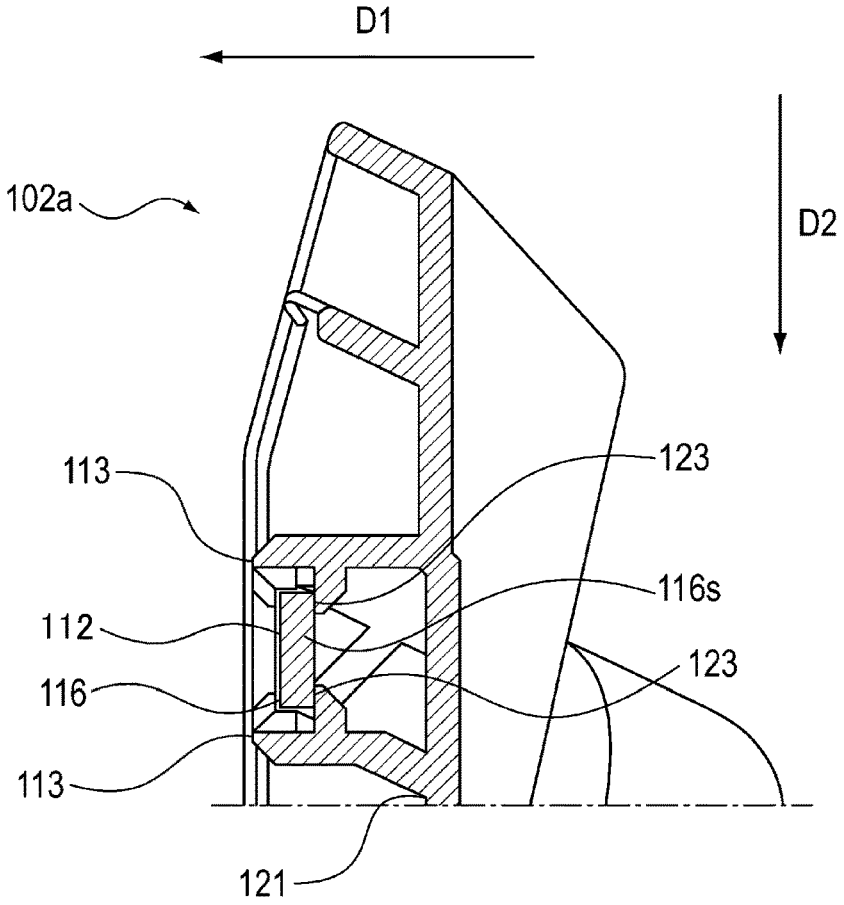

Part (a) of FIG. 12 is a perspective view of the memory unit and the electrical contact portion, and part (b) of FIG. 12 is a perspective view of a photosensitive member frame.

DESCRIPTION OF EMBODIMENTS

First Embodiment

<Image Forming Apparatus>

In the following, first, a general structure of an image forming apparatus in which a process cartridge according to a first embodiment of the present invention is mountable and from which the process cartridge is dismountable will be described together with an operation of the image forming apparatus during image formation while making reference to the drawings.

Figure 1:
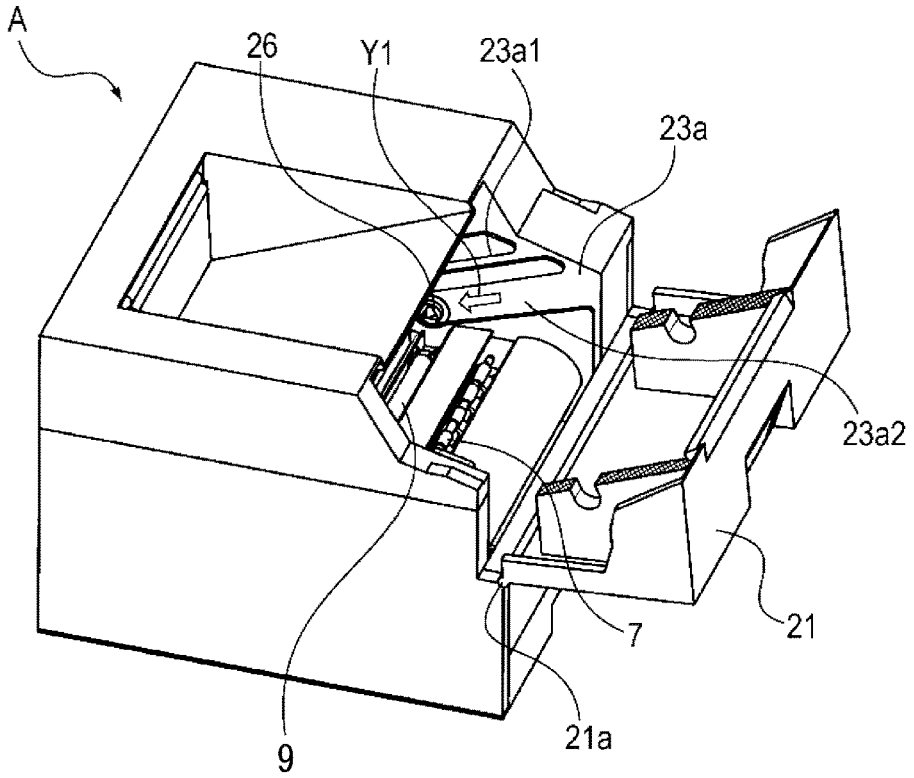
Figure 1:
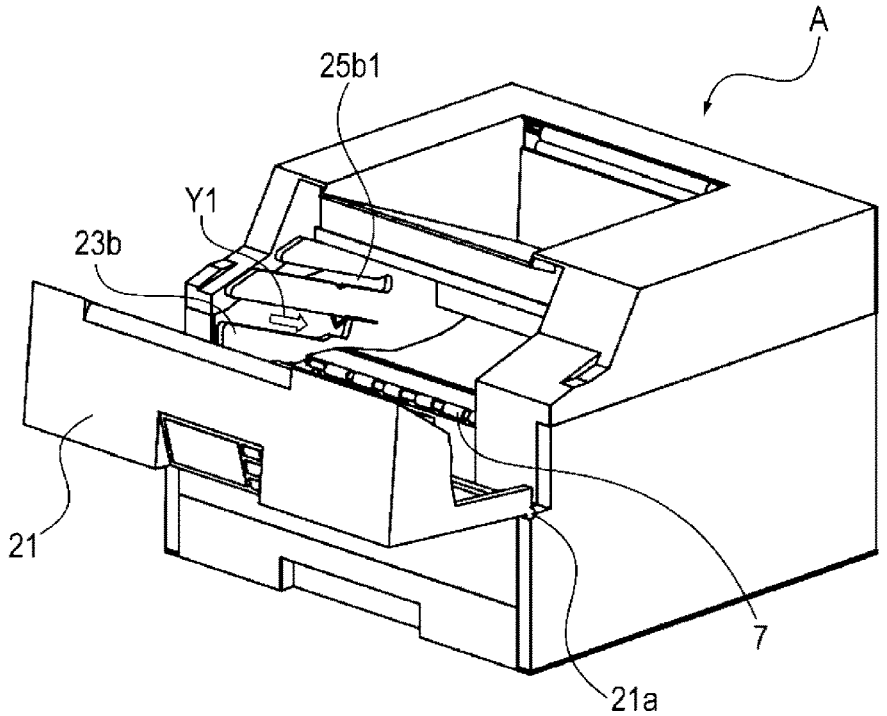
Figure 2:
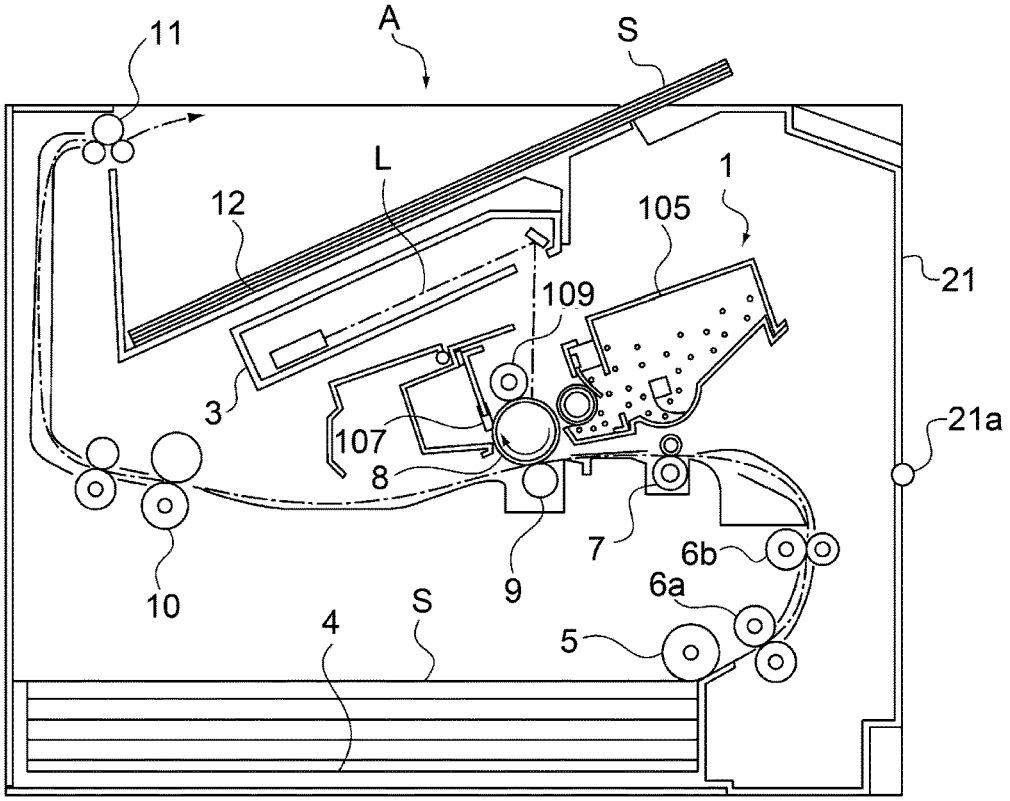
FIG. 2 is a schematic sectional view of the image forming apparatus.

Parts (a) and (b) of FIG. 1 are schematic perspective views of an image forming apparatus A. FIG. 2 is a schematic sectional view of the image forming apparatus A. Here, parts (a) and (b) of FIG. 1 show a state in which an openable door 21 of the image forming apparatus A is open, and FIG. 2 shows a state in which the openable door 21 is closed. Further, parts (a) and (b) of FIG. 1 are the perspective views of the image forming apparatus A as seen from different angles, respectively.

As shown in FIGS. 1 and 2, the image forming apparatus A includes an image forming portion for transferring a toner image onto a sheet, a sheet feeding portion for feeding the sheet toward the image forming portion, and a fixing portion for fixing the toner image on the sheet. Further, the image forming apparatus A includes the openable door 21 rotatable about a rotation shaft 21*a* and capable of being opened and closed relative to an apparatus main assembly.

The image forming portion includes a process cartridge 1 mountable in and dismountable from the apparatus main assembly of the image forming apparatus, a laser scanner unit 3, a transfer roller 9 (transfer portion) and the like.

When the process cartridge 1 is mounted, first, the openable door 21 is opened, so that an inside of the image forming apparatus A is exposed. A right-side plate 23*a* and a left-side plate 23*b* which constitute a frame 23 of the image forming apparatus A are provided with guiding grooves 23*a*1 and 23*b*1 for guiding the process cartridge 1.

Then, a grip 103 (FIG. 4) provided on the process cartridge 1 is gripped, and image guide bosses 106*a* and 106*b* and second guide bosses 107*a* and 107*b* (FIG. 7) of the process cartridge 1 are moved while being engaged with the guiding grooves 23*a*1 and 23*b*1. As a result, movement of the process cartridge 1 is guided, so that the process cartridge 1 is mounted at a predetermined position.

On the right-side plate 23*a*, below the guiding groove 23*a*1, a coupling guiding groove 23*a*2 is formed substantially parallel to the guiding groove 23*a*1. Further, on a downstream side of the coupling guiding groove 23*a*2 with respect to a mounting direction (arrow Y1 direction) of the process cartridge 1, a drive output coupling 26 rotatably by a driving force of an unshown motor is provided.

Figure 3:
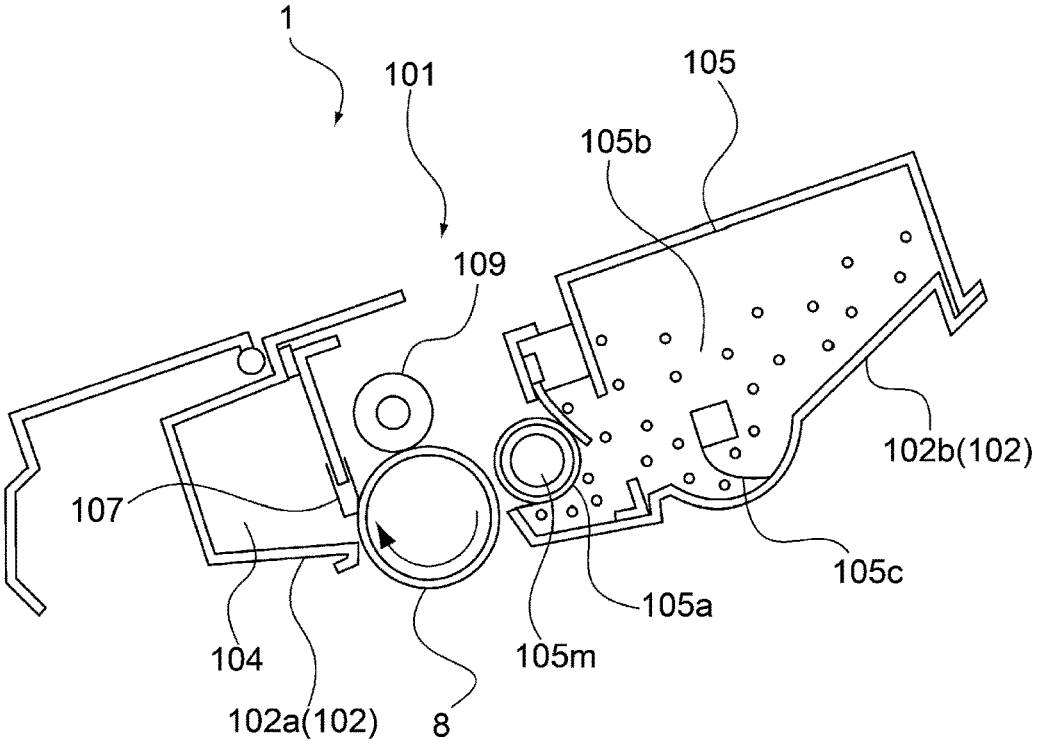
FIG. 3 is a schematic sectional view of a process cartridge.

As shown in FIG. 3, the process cartridge 1 includes a photosensitive drum 8, a charging roller 109, a developing device 105 and a cleaning blade 107. The developing device 105 includes a developing sleeve 105*a* incorporating a fixed magnet 105*m*, a toner accommodating portion 105*b*, a toner feeding member 105*c* and a developing blade 105*d*. These members are accommodated in a frame 102 of the process cartridge 1.

The frame 102 of the process cartridge 1 is constituted by a photosensitive member frame 102*s* supporting the photosensitive drum 8 and by a developing frame 102*b*, as a frame for the developing device 105, forming the toner accommodating portion 105*b*. The photosensitive member frame 102*a* and the developing frame 102*b* are connected so as to be swingable relative to each other.

Next, an image forming operation will be described. First, when a controller (not shown) receives an image forming job signal, a sheet S stacked and accommodated in a sheet stacking portion 4 is sent to a registration roller 7 by a feeding roller 5 and conveying rollers 6 (6*a*, 6*b*). Then, the sheet S is sent to the image forming portion at predetermined timing.

On the other hand, in the image forming portion, a surface of the photosensitive drum 8 contacting the charging roller 109 is electrically charged by the charging roller 109 under application of a voltage to the charging roller 109. Then, the laser scanner unit 3 emits laser light L and irradiates the photosensitive drum 8 with the laser light L depending on image information. At this time, the photosensitive drum 8 is irradiated with the laser light-passing through an opening 101 of the process cartridge 1. As a result, a potential of the photosensitive drum 8 is partially lowered, so that an electrostatic latent image depending on the image information is formed on the surface of the photosensitive drum 8.

Then, the toner in the toner accommodating portion 105*b* of the developing device 105 is fed by the toner feeding member 105*c* and is carried on the surface of the developing sleeve 105*a* by the action of the fixed magnet 105*m*. Thereafter, the developing blade 105*d* contacts the toner carried on the surface of the developing sleeve 105*a*, so that the toner is not only regulated to a predetermined film (layer) thickness but also tribe electrically charged and supplied with electric charges.

Then, by applying a voltage to the developing sleeve, the toner is deposited from the developing sleeve 105*a* on the electrostatic latent image formed on the surface of the photosensitive drum 8. As a result, a toner image depending on the image information is formed on the surface of the photosensitive drum 1.

Then, the toner image formed on the surface of the photosensitive drum 8 is sent to a transfer nip formed by the photosensitive drum 8 and the transfer roller 9. When the toner image reaches the transfer nip, a voltage of an opposite polarity to a charge polarity of the toner is applied to the transfer roller 9, so that the toner image is transferred onto the sheet S.

Thereafter, the sheet S on which the toner image is transferred is sent to a fixing device 10 (fixing portion) and is heated and pressed in a process in which the sheet S passes through a fixing nip of the fixing device 10, so that the toner image is thermally melted and is thermally fixed to the sheet S. Thereafter, the sheet S is discharged to a discharge portion 12 by a discharging roller 11.

Incidentally, the toner remaining on the surface of the photosensitive drum 8 after transfer of the toner image is removed by being scraping off with the cleaning blade 107 and is accommodated in a toner accumulating portion 104.

<Outer Casing of Process Cartridge>

Next, a structure of another casing of the process cartridge 1 will be described.

Parts (a) and (b) of FIG. 4 are perspective views of the process cartridge 1, in which the process cartridge 1 is seen from different directions from each other.

As shown in FIG. 4, the process cartridge 1 is an assembly such that a rotational axis direction (arrow D2 direction) of the photosensitive drum 8 is its longitudinal direction. A mounting and dismounting direction of the process cartridge 1 is a direction (arrow D3 direction) perpendicular to the rotational axis direction, in which an arrow Y1 direction is the mounting direction and an arrow Y2 direction is the dismounting direction.

As described above, the frame 102 of the process cartridge 1 is constituted by the photosensitive member frame 102*a* and the developing frame 102*b*. On one surface of the photosensitive drum frame 102*a*, a drive input coupling 108 is provided.

When the process cartridge 1 is mounted, the drive input coupling 108 is engaged with the coupling guiding groove 23*a*2 (FIG. 1) of the image forming apparatus A, so that movement thereof is guided and thereafter the drive input coupling 108 is engaged with a drive output coupling 26 (FIG. 1). As a result, a driving force of the unshown motor can be transmitted between the drive input coupling 108 and the drive output coupling 26, so that the photosensitive drum 8 and the developing sleeve 105*a* and the like are rotated by the transmission of the driving force to the drive input coupling 108.

Further, on the other side surface of the photosensitive member frame 102*a*, a memory unit 111 (storing portion) incorporating a memory chip (storing element) such as a RAM or a ROM for storing information on the process cartridge 1 is mounted. In the following, a structure of a periphery of the memory unit 111 will be described.

Parts (a) and (b) of FIG. 5 are a perspective view and a side view, respectively, of the periphery of the memory unit 111. As shown in FIG. 5, the memory unit 111 is bonded to and mounted on a first wall surface 121 (mounting surface) which is an upper surface of the photosensitive member frame 102*a*. Incidentally, a bonding method is, for example, a double-side tape, an adhesive, caulking or the like.

Further, a substrate 115 is provided on a substrate bearing surface 123 (projection) projecting in a normal direction (arrow D1 direction) to the first wall surface 121. Further, on the substrate 115, two electrical contact portions 112 (112*a*, 112*b*) for establishing electrical connection with those on the apparatus main assembly side of the image forming apparatus A are provided. The memory unit 111 and the electrical contact portions 112*a* and 112*b* are electrically connected by lead wires 114.

That is, the electrical contact portions 12 electrically connected to the memory unit 111 are disposed on the substrate bearing surface 123. Incidentally, a mounting surface of the substrate 115 on the substrate bearing surface 123 is opposite from the surface where the electrical contact portions 112 are provided.

Further, on the first wall surface 121, a rib 113 projecting in a normal direction to the first wall surface 121 is provided so as to surround a periphery of the electrical contact portions 112*a* and 112*b*. The rib 113 is projecting from a position different from the substrate bearing surface 123 on the first wall surface 121 and protects the electrical contact portion 112.

Of the rib 113 provided at the periphery of the electrical contact portions 112*a* and 112*b* as described above, two first ribs 113*y* extend in a direction in which the electrical contact portions 112*a* and 112*b* are adjacent to each other. Further, a second rib 113*z* is provided between the two first ribs 113*y* and connects the two first ribs 113*y*. Two third ribs 113*x* extend from the two first ribs 113*y*, respectively, in a direction perpendicular to the direction in which the electrical contact portions are adjacent to each other.

When the process cartridge 1 is mounted in the image forming apparatus A, the electrical contact portions 112 are electrically connected to electrical contact portions 51*a* (specifically described later) provided on the apparatus main assembly side of the image forming apparatus A. As a result, electrical communication between a control substrate (not shown) of the image forming apparatus A and the memory unit 111 is established. By this electrical communication, information of the member chip of the memory unit 111 is read or information is written in the memory chip. The image forming apparatus A performs various operations by using the information read from the memory chip. For example, the image forming apparatus A causes an unshown display portion to display information on a use status or the like of the process cartridge 1.

Here, with respect to the normal direction to the first wall surface 121, the first ribs 113*y* extend to a position more distant from the first wall surface 121 than a position where the electrical contact portions 112 are disposed is. That is, with respect to the normal direction to the first wall surface 121, a distance between an upper surface S1 of the memory unit 111 and free ends S3 of the first ribs 113*y* is longer than a distance between the upper surface S1 (opposite from the mounting surface of the first wall surface 121) of the memory unit 111 and upper surfaces S2 of the electrical contact portions 112.

By such a constitution, even in the case where the process cartridge 1 collides with an external member, the first rubs 113*y* or the electrical contact portions 112 contact the external member in advance of the mount 111, and therefore, breakage of the memory unit 111 can be suppressed. Further, the memory unit 111 and the electrical contact portions 112 are not flushed with each other, and therefore, a degree of freedom of arrangement of the memory unit 111 is improved, so that such a constitution can meet upsizing with an increase in capacity of the memory unit 111.

Further, with respect to the direction (arrow D2 direction) perpendicular to the normal direction (arrow D1 direction) to the first wall surface 121 and the rotational axis direction (arrow D3 direction) of the photosensitive drum 8, a part of the memory unit 111 is disposed at a position between a rotation center 8*a* of the photosensitive drum 8 and the electrical contact portions 112. By such constitution, downsizing of the photosensitive member frame 102*a* can be realized during installation of the memory unit 111. Further, an entirety of the memory unit 111 is disposed at the position between the rotation center 8*a* of the photosensitive drum 8 and the electrical contact portions 112, whereby the downsizing of the photosensitive member frame 102*a* can be further realized.

Incidentally, in this embodiment, although the memory unit 111 is mounted on the first wall surface 121, the present invention is not limited thereto. That is, for example, even in a constitution in which the memory unit 111 is disposed on a second wall surface 122 perpendicular to the first wall surface 121, an effect similar to the above-described effect can be achieved when a positional relationship among the memory unit 111, the second wall surface 122, the electrical contact portions 112 and the first ribs 113*y* is similar to the above-described positional relationship.

<Electrical Contact Portions of Image Forming Apparatus>

Next, a structure of electrical contact portions on the apparatus main assembly side of the image forming apparatus A will be described.

As shown in FIGS. 6 and 7, a connector mechanism 50 is principally constituted by a connector 51, a lower connector cover 60, an upper connector cover 52, a lever member 57 and an outer connector cover 54. The outer connector cover 54 is disposed on a scanner stay 30.

The connector 51 includes the electrical contact portions 51*a* which electrically contact the electrical contact portions 112 of the process cartridge 1 and which have a spring property. The electrical contact portions 51*a* are electrically connected to an unshown control substrate of the apparatus main assembly of the image forming apparatus A by unshown lead wires.

Further, the connector 51 includes four positioning ribs 51*b* so as to surround the electrical contact portions 51*a*. Each of the positioning ribs 51*b* has an inclined surface 51*b*1 with angles with respect to a longitudinal direction and a widthwise direction of the connector 51.

The connector 51 is supported by the lower connector cover 60 by being inserted into an opening 60*b* of the lower connector cover 60 at an inserting portion 51*c* thereof. The lower connector cover 60 is supported by the upper connector cover 52 by being inserted into an opening 52*b* of the upper connector cover 52 at an inserting portion 60*a* thereof.

Here, the connector 51, the lower connector cover 60 and the upper connector cover 52 are assembled with each other with intervals (gaps) with respect to a front-rear direction, an up-down direction and a left-right direction. As a result, the connector 51 can move relative to the lower connector cover 60 within a range in which the connector 51 does not interfere with the lower connector cover 60, and the lower connector cover 60 can move relative to the upper connector cover 52 within a range in which the lower connector cover 60 does not interfere with the upper connector cover 52.

Further, the upper connector cover 52 includes round shafts 52*c* and 52*d*. The round shafts 52*c* and 52*d* of the upper connector cover 52 rotatably engage with a circular hole 55*a* of a front connector link 55 and a circular hole 56*a* of a rear connector link 56, respectively.

Further, the outer connector cover 55 includes round shafts 54*c* and 54*d*. The round shafts 54*a* and 54*b* of the outer connector cover 55 rotatably engage with a round shaft 55*b* of a front connector link 55 and a round shaft 56*b* of a rear connector link 56, respectively.

Thus, the upper connector cover 52 is connected to the outer connector cover 54 by the front connector link 55 and the rear connector link 56. Further, these four members constitute a quadric link. Here, a distance between the round shafts 52*c* and 52*d* of the upper connector cover 52 and a distance between the circular holes 54*a* and 54*b* of the outer connector cover 54 are set so as to be equal to each other. Further, a distance between the circular hole 55*a* and the round shaft 55*b* of the front connector link 55 and a distance between the circular hole 56*a* and the round shaft 56*b* of the rear connector link 56 are set so as to be equal to each other. For this reason, the upper connector cover 52, the lower connector cover 60 and the connector 51 move while maintaining their attitudes relative to the outer connector cover 54.

The lever member 57 includes round shafts 57*a* and 57*b*. The round shaft 57*a* of the lever member 57 rotatably engages with the circular hole 54*c* of the outer connector cover 54. The round shaft 57*b* of the lever member 57 rotatably engages with a circular hole 58*b* of a lever link 58. Further, a circular hole 58*a* of the lever link 58 rotatably engages with the round shaft 56*c* of the rear connector link 56.

Thus, the lever member 56 is not only rotatably supported by the outer connector cover 54 but also is connected to the rear connector link 56 via the lever link 58. Further, these members constitute a quadric link.

Parts (a) and (b) of FIG. 8 are schematic sectional views of the connector mechanism 50, in which part (a) shows a state before the process cartridge 1 is mounted, and part (b) shows a state after the process cartridge 1 is mounted.

As shown in FIG. 8, between the connector 51 and the upper connector cover 52, a connector urging spring 532 is provided so as to be sandwiched. The connector urging spring 532 urges the connector 51 in a direction (opposite direction to arrow D1 direction) in which the connector 51 approaches the memory unit 111 of the process cartridge 1.

Further, between the lower connector cover 60 and the upper connector cover 52, a cover urging spring 531 is provided so as to be sandwiched. The cover urging spring 531 urges the lower connector cover 60 in a direction (opposite direction to arrow D1 direction) in which the lower connector cover 60 approaches the memory unit 111 of the process cartridge 1.

Further, between the outer connector cover 54 and a spring bearing 57*d* of the lever member 57, a lever urging spring 59 is provided so as to be sandwiched. The lever urging spring 59 urges the lever member 57 in an arrow V direction.

In a state in which the process cartridge 1 is dismounted from the image forming apparatus A, the inserting portion 60*a* of the lower connector cover 60 is positioned at a lower end portion of the opening 52*b* of the upper connector cover 52 by an urging force of the cover urging spring 531. Further, the inserting portion 51*a* of the connector 51 is positioned at a lower end portion of the opening 60*b* of the lower connector cover 60 by an urging force of the connector urging spring 532.

In the state in which the process cartridge 1 is dismounted from the image forming apparatus A, the lever member 57 is in a position where the lever member 57 contacts the scanner stay 30 by an urging force of the lever urging spring 59. Incidentally, in this state, the connector 51 is positioned above the scanner stay 30 and is in a position where the connector 51 is retracted from a movement locus during mounting of the process cartridge 1.

When the process cartridge 1 is mounted in the arrow Y1 direction, a lever contact portion 1201 (part (a) of FIG. 4) of the process cartridge 1 contacts a cartridge contact portion 57*c* of the lever member 57. As a result, the lever member 57 is rotated in an arrow Ma direction.

Then, with rotation of the lever member 57 in the arrow Ma direction, the front connector link 55 and the lever link 58 are rotated in an arrow Mb direction. With rotation of the links 55 and 58 in the arrow Mb direction, the upper connector cover 52, the lower connector cover 60 and the connector 51 are rotated in an arrow Mc direction while maintaining attitudes thereof relative to the outer connector cover 54. At this time, an outer surface of the connector 51 is moved in contact with an inner surface of the lower connector cover 60 while being guided in a movement direction.

By this rotation in the arrow Mc direction, the connector 51 approaches the process cartridge 1, so that the electrical contact portions 51*a* of the connector 51 and the electrical contact portions 112 of the process cartridge 1 contact each other. That is, the lower connector cover 60 is a guiding member for guiding movement of the connector 51 when the connector 51 moves toward the process cartridge 1 with the mounting of the process cartridge 1. Thereafter, by contact between a surface-to-be-contacted 60*cy* of a portion-to-be-contacted 60*c* of the lower connector cover 60 and a cover contact portion 1202 (part (b) of FIG. 4) of the process cartridge 1, the rotation in the arrow Mc direction stops.

<Positioning Structure of Connector>

Next, a positioning structure of the connector 51 relative to the process cartridge 1 will be described.

Part (a) of FIG. 9 is a plan view of the connector 51 and the lower connector cover 60 of the image forming apparatus A as seen in a normal direction (arrow D1 direction) to the first wall surface 121. Part (b) of FIG. 9 is a plan view of the periphery of the memory unit 111 of the process cartridge 1 as seen in a direction opposite to the arrow D1 direction. Parts (a) and (b) of FIG. 10 are perspective views of the connector 51, the lower connector cover 60 and the process cartridge 1, in which part (b) shows a state in which a part of the connector 51 and a part of the lower connector cover 60 are cut from a state of part (a) of FIG. 10.

As shown in FIGS. 9 and 10, when the process cartridge 1 is mounted, the ribs 113 of the photosensitive member drive 102*a* contact the four positioning ribs 51*b* of the connector 51. As a result, the position of the connector 51 relative to the process cartridge 1 with respect to the arrow D2 direction and the arrow D3 direction.

Specifically, by contact between the positioning ribs 51*b* and the third ribs 113*x*, the position of the connector 51 with respect to the rotational axis direction (arrow D3 direction) of the photosensitive drum 8 is determined. Further, by contact between the positioning ribs 51*b* and the first ribs 113*y*, the position of the connector 51 with respect to the direction (arrow D2 direction) perpendicular to the normal direction to the first wall surface 121 and the rotational axis direction of the photosensitive drum 8.

Further, by contact between the developing portions 51*z* of the connector 51 and the ribs 113 of the photosensitive member frame 102*a*, the position of the connector 51 relative to the process cartridge 1 with respect to the arrow D1 direction. Specifically, by contact between the positioning portions 51*z* of the connector 51 and the positioning portions 113$y$1 of the first ribs 113$y$, the position of the connector 51 relative to the process cartridge 1 with respect to the normal direction (arrow D1 direction) to the first wall surface 121 is determined.

Thus, by the ribs 113, positioning of the connector 51 relative to the process cartridge 1 is carried out. As a result, contact of the electrical contact portions between both members can be stabilized.

Further, the lower connector cover 60 extends in the normal direction (arrow D1 direction) to the first wall surface 121 and includes an inner wall 60$s$ perpendicular to the rotational axis direction (arrow 103 direction) of the photosensitive drum 8, so that the positioning ribs 51$b$ of the connector 51. As a result, inclination of the connector 51 is suppressed and improper contact between the connector 51 and the ribs 113 is suppressed, so that contact of the electrical contact portions both members can be stabilized.

Here, the electrical contact portions 112 of the process cartridge 1 are surrounded at the periphery thereof by the first ribs 113$y$ and the second ribs 113$e$. In a state in which the process cartridge 1 is mounted in the apparatus main assembly of the image forming apparatus A, the lower connector cover 60 disposed in a space between the electrical contact portions 112 and the memory unit 111 where the ribs are not provided. Further, there is a space between the lower connector cover 60 and the first wall surface 121. Therefore, the electroconductive wires 114 (electrical wires) pass through the space between the lower connector cover 60 and the first wall surface 121 and is contacted to the electrical contact portions 112 and the memory unit 111.

Incidentally, the memory unit 111 is disposed so as to not to overlap the positioning ribs 51$b$ and the lower connector cover 60 as seen in the rotational axis direction (arrow D3 direction) of the photosensitive drum 8. By such a constitution, it is possible to suppress breakage of the memory unit 111 due to the contact of the memory unit 111 with the connector 51 and the lower connector cover 60 when the process cartridge 1 is mounted.

Second Embodiment

Next, a second embodiment of an image forming apparatus including a process cartridge according to the present invention will be described. Portions of which explanation is redundant will be omitted from description by using the same drawings and by adding the same reference numerals or symbols.

Part (a) of FIG. 11 is a perspective view of a memory unit 111 and two electrical contact portions 12 in a process cartridge 1 according to this embodiment. As shown in part (a) of FIG. 11, in this embodiment, the memory unit 111 and the two electrical contact portions 112 are provided on a flexible substrate 116 which is bendable, and are electrically connected by an unshown electroconductive foil pattern on the flexible substrate 116. Other constitutions are similar to those of the first embodiment.

Part (b) of FIG. 11 is a perspective view of a periphery of the memory unit 111 of the process cartridge 1. As shown in part (b) of FIG. 11, a surface of the flexible substrate 116 opposite from a surface where the memory unit 111 is mounted is bonded to the first wall surface 121 by a method such as a double-side tape, an adhesive, caulking or the like. Further, a surface of the flexible substrate 116 opposite from a surface where the electrical contact portions 112 are mounted is bonded to the substrate bearing surface 123 of the photosensitive member frame 102$a$ by a similar method.

Further, a mounting position of the memory unit 111 and a mounting position of the electrical contact portions 112 are different in height. For this reason, the flexible substrate 116 is disposed by being bent at two bent portions 116$a$ and 116$b$. Incidentally, the positions and the number of these bent portions 116$a$ and 116$b$ may also be set within a range in which the bent portions do not interfere with the members.

Further, the electrical contact portions 112 of the process cartridge 1 is surrounded at a periphery thereof by first ribs 113$y$ and second ribs 113$z$. Further, in a state in which the process cartridge 1 is mounted in the apparatus main assembly of the image forming apparatus A, in a space where the ribs between the electrical contact portions 112 and the memory unit 111 are not provided, the lower connector cover 60 is disposed. Further, there is a space between the lower connector cover 60 and the first wall surface 121. Therefore, the flexible substrate 116 is disposed so as to pass through the space between the lower connector cover 60 and the first wall surface 121.

By such a constitution, the memory unit 111 and the electrical contact portions 112 can be integrally assembled, so that compared with the constitution of the first embodiment in which these members are separately mounted and are connected by the electroconductive wires, an assembling property can be improved.

Further, as shown in part (a) of FIG. 12, a block-shaped spacer 116$s$ is provided on a surface of the flexible substrate 116 opposite from a mounting surface of the electrical contact portions 112. Further, as shown in part (b) of FIG. 12, a surface of the spacer 102$a$ opposite from a surface where the spacer 116$s$ is mounted on the flexible substrate 116 is bonded and fixed to a contact bearing surface 121 of the photosensitive member frame 102$a$. As a result, rigidity of a periphery of the electrical contact portions 112 on the flexible substrate 116 becomes high, and assembling of the flexible substrate 116 to the photosensitive member frame 102$a$ becomes easy, so that an assembling property can be further improved.

According to the present invention, in the process cartridge, it is possible to not only meet an increase in capacity of the storing portion but also suppress breakage of the storing portion with collision between the external member and the storing portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-224735 filed on Nov. 30, 2018, which is hereby incorporated by reference herein in its entirety.

What is claimed is:

1. A process cartridge mountable in and dismountable from an image forming apparatus, the process cartridge comprising:

a frame;

a photosensitive member rotatably supported by the frame;

a storing portion provided on a mounting surface and configured to store information on the process cartridge;

a projection formed integrally with the mounting surface and projecting outward in a direction perpendicular to the mounting surface; and an electrical contact portion mounted on the projection and electrically connected to the storing portion, wherein the storing portion is disposed different than the projection in an axial direction of the photosensitive member, and wherein the projection includes a positioning portion protruding from the electrical contact portion in the direction perpendicular to the mounting surface, with the positioning portion being a separate member from the electrical contact portion.

2. A process cartridge according to claim 1, further comprising a flexible substrate, wherein the electrical contact portion and the storing portion are disposed on the flexible substrate.

3. A process cartridge according to claim 1, wherein a size of the storing portion is larger than a size of the electrical contact portion when viewed in the direction normal to the mounting surface.

4. A process cartridge according to claim 1, wherein the projection is provided with a supporting surface supporting the electrical contact portion, and wherein a distance between the mounting surface and the supporting surface with respect to the direction perpendicular to the mounting surface is longer than a distance between the supporting surface and a surface of the electrical contact portion.

5. An image forming apparatus comprising:

a process cartridge according to claim 1;

a transfer portion configured to transfer an image, formed using the process cartridge, onto a sheet;

a fixing portion configured to fix the image, transferred by the transfer portion, on the sheet; and a connector electrically contacting the electrical contact portion, a position of the connector to the process cartridge being determined by the connector being positioned to the positioning portion.

6. A process cartridge mountable in and dismountable from an image forming apparatus, the process cartridge comprising:

a frame;

a developing member rotatably supported by the frame;

a storing portion provided on a mounting surface and configured to store information on the process cartridge;

a projection formed integrally with the mounting surface and projecting outward in a direction perpendicular to the mounting surface; and an electrical contact portion mounted on the projection and electrically connected to the storing portion, wherein the storing portion is disposed at a position different from the projection in an axial direction of the developing member, and wherein the projection includes a positioning portion protruding from the electrical contact portion in the direction perpendicular to the mounting surface, with the positioning portion being a separate member from the electrical contact portion.

7. A process cartridge according to claim 6, further comprising a flexible substrate, wherein the electrical contact portion and the storing portion are disposed on the flexible substrate.

8. A process cartridge according to claim 6, wherein a size of the storing portion is larger than a size of the electrical contact portion when viewed in the direction normal to the mounting surface.

9. A process cartridge according to claim 8, wherein the projection is provided with a supporting surface supporting the electrical contact portion, and wherein a distance between the mounting surface and the supporting surface with respect to the direction perpendicular to the mounting surface is longer than a distance between the supporting surface and a surface of the electrical contact portion.

10. An image forming apparatus comprising:

a process cartridge according to claim 6;

a transfer portion configured to transfer an image, formed using the process cartridge, onto a sheet;

a fixing portion configured to fix the image, transferred by the transfer portion, on the sheet; and a connector electrically contacting the electrical contact portion, a position of the connector to the process cartridge being determined by the connector being positioned to the positioning portion.

* * * * *